United States Patent [19]

Okamoto

[11] Patent Number: 5,025,192

[45] Date of Patent: Jun. 18, 1991

[54] END BASE CONSTRUCTION FOR A DISCHARGE LAMP

[75] Inventor: Manabu Okamoto, Kakogawa, Japan

[73] Assignee: Ushio denki Kabushiki Kaisha, Tokyo, Japan

[21] Appl. No.: 375,873

[22] Filed: Jul. 6, 1989

[30] Foreign Application Priority Data

Jul. 26, 1988 [JP] Japan ..... 63-97989[U]

[51] Int. Cl.[5] ..... H01J 61/36

[52] U.S. Cl. ..... 313/623; 313/624; 313/318

[58] Field of Search ..... 313/623, 624, 318, 40, 313/45

[56] References Cited

U.S. PATENT DOCUMENTS 4,038,578 7/1977 Mathijssen ..... 313/623

*Primary Examiner*—Kenneth Wieder

*Attorney, Agent, or Firm*—Finnegan, Henderson, Farabow, Garrett & Dunner

[57] ABSTRACT

Disclosed herein is a discharge lamp comprising a light-emitting tubing equipped with an envelope having side tube portions of a graded seal structure; and cylindrical bases fitted on the side tube portions to cover the outer end portions of the side tube portions and fixed with a cement on the side tube portions so as to define radiating spaces. In this discharge lamp, cement-controlling members for avoiding the outflow of the cement filled in a gap between the outer peripheral surface of each side tube portion and the base into the radiating space are respectively provided in the bases. The cement-controlling member is composed of a first ring portion which stops up the gap, a second ring portion held in contact with the inner bottom surface of the base and a connecting portion. The outflow of the cement into the radiating space is prevented so that the base can be fixed strongly on the side tube portion.

2 Claims, 1 Drawing Sheet

END BASE CONSTRUCTION FOR A DISCHARGE LAMP

BACKGROUND OF THE INVENTION (1) Field of the Invention:

This invention relates to a discharge lamp suitable for use as a light source, for example, in projectors.

(2) Description of the Related Art:

In discharge lamps of a large current capacity, the rod-sealing system, in which an electrode rod is directly sealed in an envelope without using a metal foil, is often used. In a rod-sealing type discharge lamp, its light-emitting tubing is usually equipped with an envelope having a bulged portion defining a discharge space and side tube portions extending from both sides of the bulged portion. Electrode rods are provided in such a manner that they hermetically extend through the respective side tube portions into the bulged portion. The side tube portions of the envelope have a graded seal structure constructed by joining a plurality of glass members, which are different in thermal expansion coefficient, in order of their thermal expansion coefficients.

However, since the discharge lamp equipped with the side tube portions of such graded seal structure tends to crack at the side tube portions due to overheating of sealed portions, it is necessary to reduce the temperature of the sealed portions.

A conventional discharge lamp is illustrated in FIG. 2. In this figure, numerals 1 and 2 indicate an envelope and a bulged portion defining a discharge space 3, respectively, while numerals 4, 5, 6, 10, 11, 20 and 30 designate a cathode, an anode, a stem, a light-emitting tubing, a side tube portion, an electrode rod and a base, respectively. In the conventional discharge lamp, a radiating space 13 is defined by the base 30 fitted and fixed on the side tube portion 11 on the outside of the end of the side tube portion 11. Radiating apertures 61 for communicating with the radiating space 13 are defined through a peripheral wall of the base 30. Namely, the conventional discharge lamp has been designed to cool its sealed portions by air flowing through the radiating apertures 61.

The above base 30 is fixed on the side tube portion 11 with a cement B filled in a gap between the base 30 and the outer peripheral surface of the side tube portion 11. Specifically, this fixing process has been conducted in the following manner. Namely, a heat-resistant liquid cement is applied on the inner peripheral surface of the opening portion of the base 30 having the radiating apertures 61 in advance. The thus-coated base 30 is fitted on the side tube portion 11 in such a manner that the radiating space 13 is defined on the outside of the end of the side tube portion 11. The cement is then dried to fix the base 30 on the side tube portion 11.

However, a process for fitting the base 30 on the side tube portion has been found to involve a problem that the liquid cement is pressed by the outer peripheral surface of the side tube portion 11 and the like, so that the cement B flows out into the radiating space 13 and the amount of the cement present between the inner peripheral surface of the base 30 and the outer peripheral surface of the side tube portion 11 is hence too reduced to obtain insufficient bonding strength.

SUMMARY OF THE INVENTION

The present invention has been made with the foregoing circumstances in view. An object of this invention is to provide a discharge lamp capable of preventing a cement from outflowing into a radiating space and hence fixing a base to a side tube portion with sufficient bonding strength.

In one aspect of this invention, there is thus provided a discharge lamp comprising a light-emitting tubing, which is equipped with an envelope having a bulged portion defining a discharge space and side tube portions extending from both sides of the bulged portion and having a graded seal structure constructed by joining a plurality of glass members, which are different in thermal expansion coefficient, in order of their thermal expansion coefficients, and has electrode rods hermetically extending through the respective side tube portions into the bulged portion; and cylindrical bases fitted on the respective side tube portions in such a manner that the bases cover respectively the outer end portions of the side tube portions and fixed with a cement on the respective side tube portions so as to define radiating spaces in which the outer surfaces of the ends of the side tube portions are respectively positioned. Cement-controlling members for avoiding the outflow of the cement filled in a gap between the outer peripheral surface of each side tube portion and the base into the radiating space are respectively provided in the bases. Each of the cement-controlling members is composed of a first ring portion received in an annular recess defined by the outer periphery of the end wall of the side tube portion and the inner peripheral surface of the base so as to be held in contact with both outer periphery of the end wall of the side tube portion and inner peripheral surface of the base, a second ring portion held in contact with the inner bottom surface of the base and a connecting portion adapted to connect the first ring portion to the second ring portion.

According to this invention, the outflow of the cement into the radiating space is avoided by the first ring portion when the base applied with the cement on the inner peripheral surface thereof is fitted on the side tube portion, because the cement-controlling member comprising the first ring portion, connecting portion and second ring portion is disposed within the base in a specific position.

Accordingly, there is nothing that the amount of the cement present between the inner peripheral surface of the base and the outer peripheral surface of the side tube portion is lacking. The base can hence be fixed on the side tube portion with sufficient bonding strength.

The above and other objects, features and advantages of the present invention will become apparent from the following description and the appended claims, taken in conjunction with the accompanying drawing.

DETAILED DESCRIPTION OF THE INVENTION AND PREFERRED EMBODIMENTS

Figure 1:
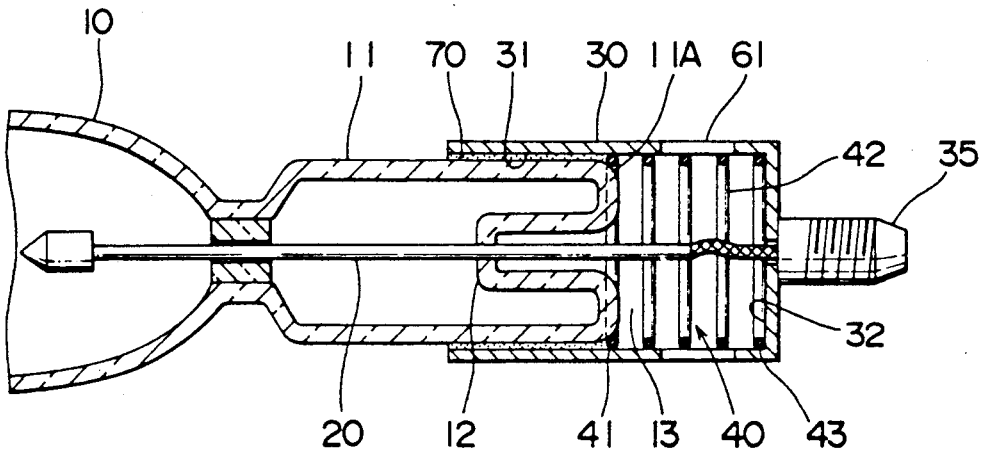
FIG. 1 is an explanatory cross-section of a discharge lamp according to one embodiment of this invention.
Figure 2:
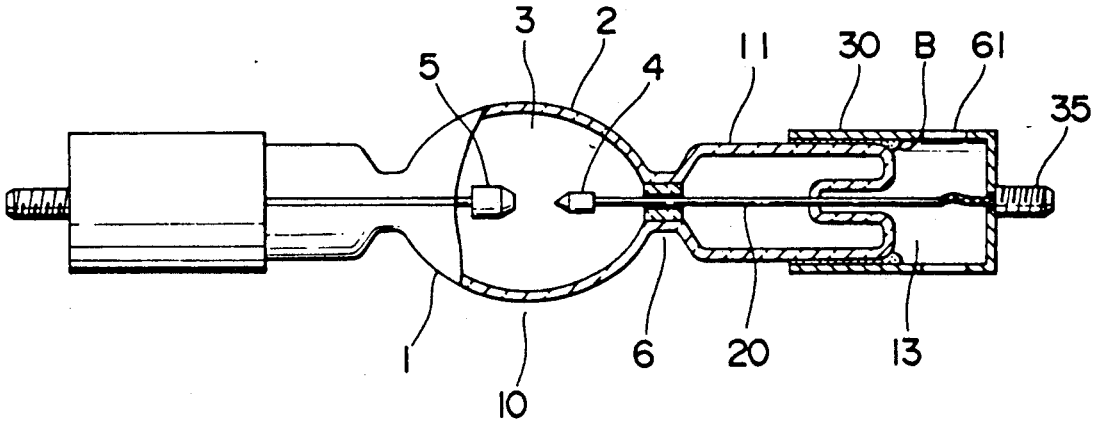
FIG. 2 (PRIOR ART)
FIG. 2 is an explanatory cross-section of an illustrative conventional discharge lamp having a graded seal structure.

One embodiment of the present invention will hereinafter be described in conjunction with the drawing.

Referring now to FIG. 1, a discharge lamp according to the embodiment of the present invention is explanatorily illustrated.

Numeral 10 indicates a light-emitting tubing made of glass and having, on both sides thereof, side tube portions 11 of a graded seal structure. The graded seal structure is constructed by joining a plurality of glass members, which are different in thermal expansion coefficient, in order of their thermal expansion coefficients. A glass portion 12 in the side tube portion 11 is hermetically fusion-bonded to an electrode rod 20 to form a seal portion.

The side tube portion 11 is usually formed by joining three or four glass members. As its example, when the bulged portion of the light-emitting tubing 10 is made of quartz glass (thermal expansion coefficient: $5\times10^{-7}$/° C.) and the electrode rod 20 is made of tungsten (thermal expansion coefficient: $50\times10^{-7}$/° C.), a first glass member adjoining the bulged portion is joined with a second glass member, to which a third glass member is united, said third glass member being fusion-bonded to the electrode rod 20. These three glass members may be all composed of boro-silicate glass. The first, second and third glass members have thermal expansion coefficients of $10\times10^{-7}$/°C., $14\times10^{-7}$/°C. and $25\times10^{-7}$/°C. respectively.

Numeral 30 designates a cylindrical base made of brass by way of example. The base 30 is fixed with a cement on the side tube portion 11 in such a manner that a radiating space 13 is defined on the outside of the end of the side tube portion 11. Specifically, the base 30 is fitted on the side tube portion 11 in the state that the base 30 covers the outer end portion of the side tube portion 11 so as to define the radiating space 13 by the inner bottom surface 32 of the base 30 and the inner peripheral surface extending therefrom, and the outer surface of the end wall 11A of the side tube portion 11, and is fixed with a cement, which has been applied on the inner peripheral surface 31 of the base 30 in advance, on the outer peripheral surface of the side tube portion 11. Numerals 61 and 70 indicate radiating apertures and a cement layer respectively.

Numeral 40 designates a cement-controlling member. The controlling member 40 is provided in the radiating space 13 of the base 30 to prevent the cement from outflowing into the radiating space 13 when the base 30 is fitted on the side tube portion 11.

In the controlling member 40, numerals 41, 42 and 43 indicate a first ring portion, a connecting portion and a second ring portion respectively. These portions can be integrally formed, for example, by working a metal wire having a wire diameter of about 1-3 mm into a coil of several turns.

It is necessary for the controlling member 40 to have low spring property, because the fixing process with the cement in the process in which the base 30 is fitted on the side tube portion 11 becomes difficult when the springness of the cement-controlling member 40 is high. Therefore, the controlling member 40 is preferably formed with a plastic metallic material, which exhibits low spring property when worked in a coil shape and is susceptible to plastic deformation, for example, aluminum.

The first ring portion 41 of the controlling member 40 is received in an annular recess defined by the outer periphery of the end wall 11A of the side tube portion 11 and the inner peripheral surface 31 of the base 30 so as to be held in contact with both end wall 11A of the side tube portion and inner peripheral surface 31 of the base 30 and to stop up the gap between the base 30 and the side tube portion 11.

The second ring portion 43 is held in contact with the inner bottom surface 32 of the base 30. The connecting portion 42 is in a spiral shape and serves to connect the first ring portion 41 and the second ring portion 43. Incidentally, the shape of the connecting portion 42 is not limited to the spiral form.

The base 30 can be cemented and fixed on the side tube portion 11 in the following manner.

The controlling member 40 is first of all inserted within the base 30 and deposited in a position that the second ring portion 43 is held in contact with the inner bottom surface 32 of the base 30. By the way, it is necessary to make the initial length of the controlling member 40 somewhat longer in advance. A heat-resistant cement formed of a ceramic material by way of example is then applied on the inner peripheral surface 31 of the opening portion of the base 30. The base 30 is then fitted on the side tube portion 11 in such a manner that the side tube portion 11 is inserted in the base 30, and the fitting depth of the base 30 is gradually increased in the state that the first ring portion 41 of the controlling member 40 is received in the annular recess defined by the outer periphery of the end wall 11A of the side tube portion 11 and the inner peripheral surface 31 of the base 30 and held in contact with the end wall 11A. Accordingly, the entirety of the controlling member 40 is gradually compressed as retaining a state that the first ring portion 41 has been held in contact with the end wall 11A of the side tube portion 11 and the inner peripheral surface 31 of the base 30, resulting in its plastic deformation.

The cement is then dried in the state that the fitting depth of the base 30 has reached a predetermined level, whereby the base 30 is cemented and fixed on the side tube portion 11.

Although description has been made as to the cathode side of the discharge lamp, the same applies to the anode side.

According to the discharge lamp of the above-described construction, because it has a feature that the controlling member 40 is disposed within the base 30 and the first ring portion 41 stops up the gap between the inner peripheral surface 31 of the base 30 and the outer peripheral surface of the side tube portion 11, the outflow of the cement into the radiating space 13 is prevented by the first ring portion 41 when the cement is applied on the inner peripheral surface 31 of the base 30 to fit the same on the side tube portion 11. Therefore, the base 30 can be cemented and fixed on the side tube portion 11 with a desired amount of the cement, whereby the bonding strength of the base 30 to the side tube portion 11 becomes sufficient.

As has been described above, according to this invention, since the controlling member of the specific structure is disposed in the radiating space defined by the base and the end wall of the side tube portion and the first ring portion of the controlling member hence stops up the gap between the base and the side tube portion, the outflow of the cement into the radiating space is prevented by the first ring portion of the controlling member when the base with the cement applied on its inner peripheral surface is fitted on the side tube portion. As a result, the base can be cemented and fixed on the side tube portion with sufficient bonding strength.

Having now fully described the invention, it will be apparent to one of ordinary skill in the art that many changes and modifications can be made thereto without departing from the spirit or scope of the invention as set forth herein.

What is claimed is:

1. In a discharge lamp comprising a light-emitting tubing, which is equipped with an envelope having a bulged portion defining a discharge space and side tube portions extending from both sides of the bulged portion and having a graded seal structure constructed by joining a plurality of glass members, each having progressively higher thermal coefficients of expansion in an order proceeding from said bulged portion, and has electrode rods hermetically extending through the respective side tube portions into the bulged portion; and cylindrical bases fitted on the respective side tube portions in such a manner that the bases cover respectively the outer end portions of the side tube portions with a gap between the outer peripheral surface of each side to portion and the base and fixed with a cement filling said gap on the respective side tube portions so as to define radiating spaces in which the outer surfaces of the ends of the side tube portions are respectively positioned, the improvement wherein cement-controlling members for avoiding the outflow of the cement from said gap into the radiating space are respectively provided in the bases, each of the cement-controlling members comprising a first ring portion received in an annular recess defined by the outer periphery of the end wall of the side tube portion and the inner peripheral surface of the base so as to be held in contact with both outer periphery of the end wall of the side tube portion and inner peripheral surface of the base, a second ring portion held in contact with the inner bottom surface of the base and a connecting portion adapted to connect the first ring portion and the second ring portion.

2. The discharge lamp as claimed in claim 1, wherein the cement-controlling member is formed of a plastic metallic material.

* * * * *

UNITED STATES PATENT AND TRADEMARK OFFICE

CERTIFICATE OF CORRECTION

PATENT NO. : 5,025,192

DATED : June 18, 1991

INVENTOR(S) : Manabu OKAMOTO

It is certified that error appears in the above-identified patent and that said Letters Patent is hereby corrected as shown below:

Title Page, Assignee, change "denki" to --Denki--.

Signed and Sealed this

Tenth Day of November, 1992

*Attest:*

DOUGLAS B. COMER

*Attesting Officer*

*Acting Commissioner of Patents and Trademarks*